US008251650B2

(12) United States Patent
Ibaraki et al.

(10) Patent No.: US 8,251,650 B2
(45) Date of Patent: Aug. 28, 2012

(54) COMPRESSOR HOUSING

(75) Inventors: Seiichi Ibaraki, Nagasaki-ken (JP); Yasuaki Jinnai, Kanagawa-ken (JP); Masaki Tojo, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 733 days.

(21) Appl. No.: 12/360,522

(22) Filed: Jan. 27, 2009

(65) Prior Publication Data

US 2009/0290979 A1 Nov. 26, 2009

(30) Foreign Application Priority Data

May 23, 2008 (JP) ..... 2008-135540

(51) Int. Cl.
*F04D 29/42* (2006.01)

(52) U.S. Cl. ..... 415/200; 415/203; 415/204

(58) Field of Classification Search ..... 315/200, 315/203, 204, 173.1, 173.2, 173.6, 174.1
See application file for complete search history.

(56) References Cited

U.S. PATENT DOCUMENTS

| | | | | | |
|---|---|---|---|---|---|
| 1,735,754 | A * | 11/1929 | Hargis | 415/128 |
| 1,743,916 | A * | 1/1930 | Hargis | 415/128 |
| 3,032,259 | A * | 5/1962 | Jassniker | 415/148 |
| 5,427,498 | A * | 6/1995 | Lehe et al. | 415/58.2 |
| 5,456,578 | A * | 10/1995 | Honda et al. | 415/214.1 |
| 5,653,577 | A * | 8/1997 | Wuhrer | 415/1 |
| 5,785,493 | A * | 7/1998 | Ojima et al. | 415/174.1 |
| 5,961,281 | A * | 10/1999 | Ojima et al. | 415/173.6 |
| 6,464,454 | B1 * | 10/2002 | Kotkaniemi | 415/121.1 |
| 6,506,015 | B2 * | 1/2003 | Nagata et al. | 415/173.1 |
| 7,037,069 | B2 * | 5/2006 | Arnold et al. | 415/128 |
| 7,179,051 | B2 * | 2/2007 | Williams et al. | 415/204 |
| 7,306,427 | B2 * | 12/2007 | Ahlroth et al. | 415/196 |
| 7,775,762 | B2 * | 8/2010 | Koenig | 415/60 |
| 2009/0290979 | A1 * | 11/2009 | Ibaraki et al. | 415/200 |
| 2010/0005799 | A1 * | 1/2010 | Nikpour | 60/605.1 |
| 2010/0247296 | A1 * | 9/2010 | Matsuyama | 415/170.1 |
| 2011/0097194 | A1 * | 4/2011 | Schick et al. | 415/119 |

FOREIGN PATENT DOCUMENTS

| | | | |
|---|---|---|---|
| JP | 06-307250 | A | 11/1994 |
| JP | 2000-205192 | A | 7/2000 |
| JP | 2001-234753 | A | 8/2001 |
| JP | 3294491 | B2 | 6/2002 |
| JP | 2002-256878 | A | 9/2002 |
| JP | 2008-19798 | A | 1/2008 |

OTHER PUBLICATIONS

Japanese Office Action dated Mar. 27, 2012 for Japanese Patent Application No. 2008-135540.

* cited by examiner

*Primary Examiner* — Ross Gushi
(74) *Attorney, Agent, or Firm* — Westerman, Hattori, Daniels & Adrian, LLP

(57) ABSTRACT

The present invention provides a compressor housing capable of reducing the weight of a compressor without leading to an increase in the size and a reduction in the efficiency of the compressor. The compressor housing includes: an inner cylinder made of a plastic material and extending in an axial direction and in a circumferential direction to surround blade tips of the blades; and an outer cylinder made of a plastic material and extending in the axial direction and in the circumferential direction to surround the inner cylinder. The inner cylinder and the outer cylinder are bonded or jointed at the first end, opposite the second end where the volute is formed.

10 Claims, 5 Drawing Sheets

COMPRESSOR HOUSING

BACKGROUND OF THE INVENTION

1. Field of the Invention

The present invention relates to housings for compressors such as centrifugal compressors or mixed flow compressors used in aviation gas turbines, marine superchargers, and automotive superchargers, for example.

2. Description of Related Art

A known compressor used for aviation gas turbines, marine superchargers, and automotive superchargers uses the technology disclosed in Japanese Unexamined Patent Application, Publication No. 2008-19798.

In recent years, attempts have been made to construct the entire compressor housing of plastic from the standpoint of reducing the weight and cost. However, as indicated by double-dashed chain lines in FIG. 6, an outlet part (more specifically, a part where a volute 101 is provided) of a housing 102 is thermally deformed by air having a high temperature (for example, 180° C.) compressed in a compressor 100, thus increasing a clearance between blade tips 7*a* of blades 7 and an inner circumferential face 102*a* of the housing 102, thereby reducing the efficiency of the compressor 100.

Thus, a housing 202 of a compressor 200 shown in FIG. 7 has been conceived; the entire wall of the housing 202 is made thick toward the outer side in the radial direction, and ribs 203 are provided on the outer surface of the housing 202 where the volute 101 is formed. However, in the housing 202 of the compressor 200, the length in the radial direction is increased, thus causing an increase in the size and the weight of the entire compressor 200.

Note that the solid line drawn in the center portion of the housing 202 in FIG. 7 indicates the wall thickness of the housing 102 shown in FIG. 6.

BRIEF SUMMARY OF THE INVENTION

In view of the above-described circumstances, the present invention has been made, and an object of the present invention is to provide a compressor housing capable of reducing the weight of a compressor without leading to an increase in the size and a reduction in the efficiency of the compressor.

In order to solve the problems described above, the present invention employs the following solutions.

According to a first aspect, the present invention provides a compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, the compressor housing including: an inner cylinder made of a plastic material and extending in an axial direction and in a circumferential direction to surround blade tips of the blades; and an outer cylinder made of a plastic material and extending in the axial direction and in the circumferential direction to surround the inner cylinder, in which the inner cylinder and the outer cylinder are bonded or jointed at the first end, opposite the second end where the volute is formed.

According to the compressor housing of the present invention, only the first end (or the first end and the center part) of the inner cylinder is bonded with the first end (or the first end and the center part) of the outer cylinder, and the second end of the inner cylinder is not bonded or jointed with the second end of the outer cylinder, so that only the second end (where the volute is provided) of the outer cylinder is thermally deformed by compressed air having a high temperature (for example, 180° C.).

Therefore, it is possible to always maintain a clearance between the blade tips of the blades and the inner circumferential face of the inner cylinder at an appropriate distance and to prevent a reduction in the efficiency of the compressor.

The wall thickness of the housing can be made almost equal to that of a housing made of a metal material such as cast aluminum alloy, cast iron, or cast steel, so that it is possible to prevent an increase in the size of the housing and an increase in the size of the compressor.

Furthermore, since the entire housing is made of a plastic material, the weight of the housing can be reduced.

According to a second aspect, the present invention provides a compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, the compressor housing including: an inner cylinder made of a metal material and extending in an axial direction and in a circumferential direction to surround blade tips of the blades; and an outer cylinder made of a plastic material and extending in the axial direction and in the circumferential direction to surround the inner cylinder, in which the inner cylinder and the outer cylinder are bonded at the first end, opposite the second end where the volute is formed.

According to the compressor housing of the present invention, only the first end (or the first end and the center part) of the inner cylinder is bonded or jointed with the first end (or the first end and the center part) of the outer cylinder, and the second end of the inner cylinder is not bonded with the second end of the outer cylinder, so that only the second end (where the volute is provided) of the outer cylinder is thermally deformed by compressed air having a high temperature (for example, 180° C.).

Therefore, it is possible to always maintain the clearance between the blade tips of the blades and the inner circumferential face of the inner cylinder at an appropriate distance and to prevent a reduction in the efficiency of the compressor.

When the inner cylinder is made of a metal material such as cast aluminum alloy, even if the blades are damaged and scattered outward in the radial direction, it is possible to prevent fragments of the blades from flying outside the housing and to improve the reliability of the compressor.

Additionally, the wall thickness of the inner cylinder can be reduced, so that it is possible to reduce the wall thickness of the entire housing and to reduce the sizes of the housing and the compressor.

Since most (the main part) of the housing is made of a plastic material, the weight of the housing can be reduced.

In a compressor housing according to a third aspect of the present invention, the inner cylinder and the outer cylinder in the first or second aspect are bonded or jointed at the first end, opposite the second end where the volute is formed, and a clearance is provided in advance between the other portions of the inner cylinder and the outer cylinder.

According to the compressor housing of the present invention, only the first end of the inner cylinder is bonded or jointed with the first end of the outer cylinder, and a clearance is provided between the other portions of the inner cylinder and the outer cylinder, so that only the second end (where the volute is provided) of the outer cylinder is thermally deformed by compressed air having a high temperature (for example, 180° C.). With the clearance being provided, heat transfer from the inner cylinder to the outer cylinder is suppressed, thereby suppressing a temperature increase at the outer cylinder more than in the first and second aspects. Therefore, deformation of the housing is suppressed.

Therefore, it is possible to always maintain the clearance between the blade tips of the blades and the inner circumferential face of the inner cylinder at an appropriate distance and to prevent a reduction in the efficiency of the compressor.

According to a fourth aspect, the present invention provides a compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, in which a core member made of a metal material is embedded in a housing main body made of a plastic material in an axial direction and in a circumferential direction to surround blade tips of the blades.

According to the compressor housing of the present invention, the core member embedded in the housing main body prevents (inhibits) the second end (where the volute is provided) of the housing from being thermally deformed.

Therefore, it is possible to always maintain the clearance between the blade tips of the blades and the inner circumferential face of the housing main body at an appropriate distance and to prevent a reduction in the efficiency of the compressor.

Since the core member is made of a metal material such as aluminum alloy, even if the blades are damaged and scattered outward in the radial direction, it is possible to prevent fragments of the blades from flying outside the housing and to improve the reliability of the compressor.

Additionally, the wall thickness of the inner cylinder can be reduced, so that it is possible to reduce the wall thickness of the entire housing and to reduce the sizes of the housing and the compressor.

Since most (the main part) of the housing is made of a plastic material, the weight of the housing can be reduced.

According to a fifth aspect, the present invention provides a compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, in which a slit is provided which is cut into an inner wall face of the volute, the inner wall face being made of a plastic material and located at an inner side in a radial direction, toward an inner side in the radial direction along a plane approximately perpendicular to the rotational axis of the impeller.

According to the compressor housing of the present invention, the slit is formed at the second end of the housing and thus only the second end (where the volute is provided) of the housing is thermally deformed by compressed air having a high temperature (for example, 180° C.).

Therefore, it is possible to always maintain the clearance between the blade tips of the blades and an inner circumferential face of the housing at an appropriate distance and to prevent a reduction in the efficiency of the compressor.

The wall thickness of the housing can be made almost equal to that of a housing made of a metal material such as cast aluminum alloy, cast iron, or cast steel, so that it is possible to prevent an increase in the size of the housing and an increase in the size of the compressor.

Further, since the entire housing is made of a plastic material, the weight of the housing can be reduced.

According to a compressor provided with any one of the housings described above, the weight of the compressor is reduced and the reliability of the compressor is improved, without leading to an increase in the size and a reduction in the efficiency of the compressor.

According to the compressor housing of the present invention, it is possible to reduce the weight of a compressor without leading to an increase in the size and a reduction in the efficiency of the compressor.

DETAILED DESCRIPTION OF THE INVENTION

A compressor housing according to a first embodiment of the present invention will be described below with reference to FIGS. 1 and 2.

Figure 1:
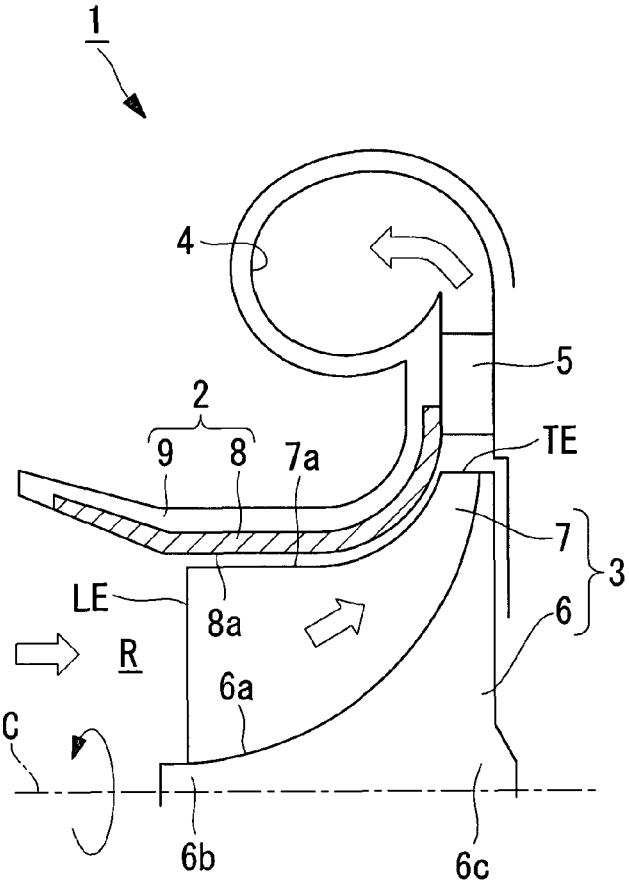
FIG. 1 is a cross-sectional view of a compressor provided with a compressor housing according to first and second embodiments of the present invention.
Figure 2:
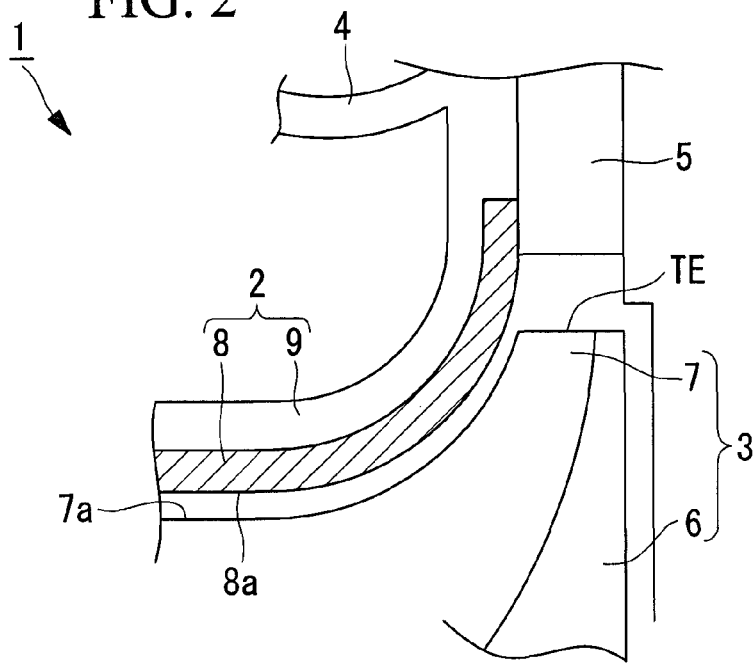
FIG. 2 is an enlarged view of main parts shown in FIG. 1.

FIG. 1 is a cross-sectional view of a compressor (hereinafter referred to as "centrifugal compressor") provided with the compressor housing (hereinafter referred to as "housing") according to this embodiment. FIG. 2 is an enlarged view of main parts shown in FIG. 1.

As shown in FIG. 1, a centrifugal compressor 1 includes a housing 2, an impeller 3 axially-supported by the housing 2 to allow rotation thereof, a volute (scroll) 4 provided around the impeller 3 to form a single body with the housing 2, and a ring shaped diffuser 5 provided between the impeller 3 and the volute 4 to surround the circumference of the impeller 3.

In FIG. 1, the outline arrows indicate the flow of air (working fluid), reference symbol C indicates a rotational axis of the impeller 3, and reference symbol R indicates an intake passage.

The impeller 3 includes a hub (main body) 6 and a plurality of blades (moving blades) 7 radially provided (arranged) on a surface (hereinafter referred to as "hub face") 6*a* of the hub 6.

Each of the blades 7 is provided on the hub face 6*a* such that a leading edge LE of the blade 7 is located at a small-diameter end 6*b* of the hub 6 and a trailing edge TE of the blade 7 is located at a large-diameter end 6*c* of the hub 6.

The housing 2 of this embodiment includes an inner cylinder 8 extending in the axial direction and in the circumferential direction to surround blade tips 7*a* of the blades 7, and an outer cylinder 9 extending in the axial direction and in the circumferential direction to surround the inner cylinder 8.

The inner cylinder 8 is a cylindrical member made of a plastic material such as polyamide, in which a first end (left end in FIG. 1) thereof is located farther upstream than the leading edge LE of the blade 7, a second end (right end in FIG. 1) thereof is located farther downstream than the trailing edge TE of the blade 7, and the diameter increases in a radial direction toward the second end thereof. An inner circumferential face 8*a* of the inner cylinder 8, which faces the blade tips 7*a* of the blades 7, is formed to have a predetermined clearance between the inner circumferential face 8*a* and the blade tips 7*a* of the blades 7.

The outer cylinder 9 is a member formed to surround the radially outer side of the inner cylinder 8 and is made of a plastic material such as polyamide, in which a first end (left end in FIG. 1) thereof is located farther upstream than the first end of the inner cylinder 8, and a second end (right end in FIG. 1) thereof is located farther downstream than the second end of the inner cylinder 8. Further, the volute 4 is formed at the second end of the outer cylinder 9.

The inner cylinder 8 and the outer cylinder 9 are bonded or jointed with each other, for example, by adhesive at portions other than the second ends toward which the diameters increase in the radial direction (that is, at their first ends or at their center portions). The second end of the inner cylinder 8 and the second end of the outer cylinder 9 are not bonded with each other. The second end of the outer cylinder 9 can be deformed with respect to the second end of the inner cylinder 8.

According to the housing 2 of this embodiment, the second end of the inner cylinder 8 is not bonded with the second end of the outer cylinder 9. Only the second end (where the volute 4 is provided) of the outer cylinder 9 is thermally deformed by compressed air having a high temperature (for example, 180° C.).

Therefore, it is possible to always maintain the clearance between the blade tips 7*a* of the blades 7 and the inner circumferential face 8*a* of the inner cylinder 8 at an appropriate distance and to prevent a reduction in the efficiency of the centrifugal compressor 1.

The wall thickness of the housing 2 can be made almost equal to that of a housing made of a metal material such as aluminum cast iron or cast steel, so that it is possible to prevent an increase in the size of the housing 2 and an increase in the size of the centrifugal compressor 1.

Further, since the entire housing 2 is made of a plastic material, the weight of the housing 2 can be reduced.

A compressor housing according to a second embodiment of the present invention has an inner cylinder 8 identical to that of the first embodiment except that it is made of a metal material such as cast aluminum alloy, which is more preferable.

When the inner cylinder 8 is made of a metal material such as cast aluminum alloy, even if the blades 7 are damaged and scattered outward in the radial direction, it is possible to prevent fragments of the blades 7 from flying outside the housing 2 and to improve the reliability of the centrifugal compressor 1.

Additionally, the wall thickness of the inner cylinder 8 can be reduced, so that it is possible to reduce the wall thickness of the entire housing 2 and to reduce the sizes of the housing 2 and the centrifugal compressor 1.

A housing 22 according to a third embodiment of the present invention will be described with reference to FIG. 3.

Figure 3:
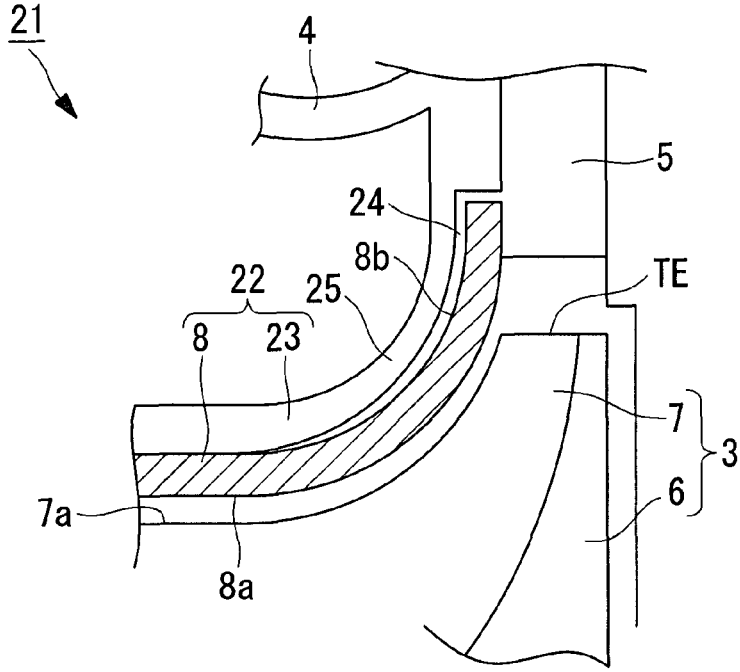
FIG. 3 is an enlarged view of main parts of a compressor provided with a compressor housing according to a third embodiment of the present invention.

As shown in FIG. 3, the housing 22 of this embodiment is different from those of the first and second embodiments in that an outer cylinder 23 is provided instead of the outer cylinder 9 described in the first and second embodiments. Since the other components are the same as those of the first and second embodiments, a description of those components will be omitted.

The outer cylinder 23 has a thin-walled part 25 facing the second end of the inner cylinder 8 such that a clearance 24 shown in FIG. 3 is produced between the thin-walled part 25 and an outer circumferential face 8*b* of the inner cylinder 8 when the inner cylinder 8 is bonded with the radially inner side of the outer cylinder 23.

According to the housing 22 of this embodiment, the clearance 24 is produced between the second end of the inner cylinder 8 and the second end of the outer cylinder 23, and only the second end (where the volute 4 is provided) of the outer cylinder 23 is thermally deformed by compressed air having a high temperature (for example, 180° C.). With the clearance 24 being provided, heat transfer from the inner cylinder 8 to the outer cylinder 23 is suppressed, thereby suppressing a temperature increase at the outer cylinder more than in the first and second embodiments. Therefore, deformation of the housing is suppressed.

Therefore, it is possible to always maintain the clearance between the blade tips 7*a* of the blades 7 and the inner circumferential face 8*a* of the inner cylinder 8 at an appropriate distance and to prevent a reduction in the efficiency of a centrifugal compressor 21.

The wall thickness of the housing 22 can be made almost equal to that of a housing made of a metal material such as cast aluminum alloy, cast iron, or cast steel, so that it is possible to prevent an increase in the size of the housing 22 and an increase in the size of the centrifugal compressor 21.

Further, since the entire housing 22 is made of a plastic material, the weight of the housing 22 can be reduced.

Note that, in this embodiment, it is more preferable that the inner cylinder 8 be made of a metal material such as cast aluminum alloy.

When the inner cylinder 8 is made of a metal material such as cast aluminum alloy, even if the blades 7 are damaged and scattered outward in the radial direction, it is possible to prevent fragments of the blades 7 from flying outside the housing 22 and to improve the reliability of the centrifugal compressor 21.

Additionally, the wall thickness of the inner cylinder 8 can be reduced, so that it is possible to reduce the wall thickness of the entire housing 22 and to reduce the sizes of the housing 22 and the centrifugal compressor 21.

A housing 42 according to a fourth embodiment of the present invention will be described with reference to FIG. 4.

Figure 4:
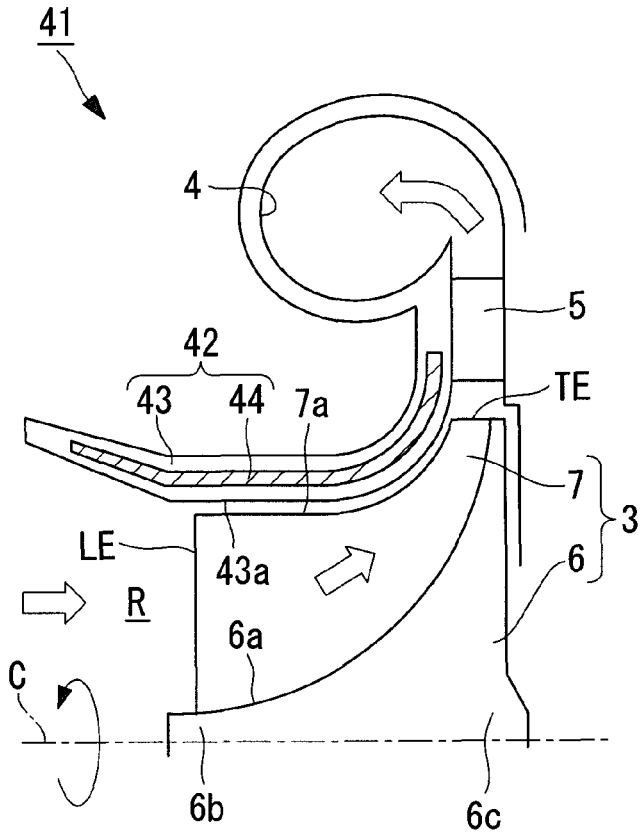
FIG. 4 is a cross-sectional view of a compressor provided with a compressor housing according to a fourth embodiment of the present invention.

As shown in FIG. 4, the housing 42 of this embodiment is different from those of the above-described embodiments in that a core member 44 made of a metal material such as cast aluminum alloy is embedded in a housing main body 43 made of a plastic material such as polyamide, in the axial direction and in the circumferential direction to surround the blade tips 7*a* of the blades 7. Since the other components are the same as those of the above-described embodiments, a description of those components will be omitted.

The core member 44 is a cylindrical member in which a first end (left end in FIG. 4) thereof is located farther upstream than the leading edge LE of the blade 7, a second end (right end in FIG. 4) thereof is located farther downstream than the trailing edge TE of the blade 7, and the diameter increases in the radial direction toward the second end thereof. An inner circumferential face 43*a* of the housing main body 43, which faces the blade tips 7*a* of the blades 7, is formed to have a predetermined clearance between the inner circumferential face 43*a* and the blade tips 7*a* of the blades 7.

According to the housing 42 of this embodiment, the core member 44 embedded in the housing main body 43 prevents (inhibits) a second end (where the volute 4 is provided) of the housing 42 from being thermally deformed.

Therefore, it is possible to always maintain the clearance between the blade tips 7*a* of the blades 7 and the inner circumferential face 43*a* of the housing main body 43 at an appropriate distance and to prevent a reduction in the efficiency of a centrifugal compressor 41.

The wall thickness of the housing 42 can be made almost equal to that of a housing made of a metal material such as aluminum cast iron or cast steel, so that it is possible to prevent an increase in the size of the housing 42 and an increase in the size of the centrifugal compressor 41.

Furthermore, since most (the main part) of the housing 42 is made of a plastic material, the weight of the housing 42 can be reduced.

Since the core member 44 is made of a metal material such as cast aluminum alloy, even if the blades 7 are damaged and scattered outward in the radial direction, it is possible to prevent fragments of the blades 7 from flying outside the housing 42 and to improve the reliability of the centrifugal compressor 41.

Furthermore, since the core member 44 is made of a metal material such as cast aluminum alloy, it is possible to reduce the wall thickness of the entire housing 42 and to further reduce the sizes of the housing 42 and the centrifugal compressor 41.

A housing 52 according to a fifth embodiment of the present invention will be described with reference to FIG. 5.

Figure 5:
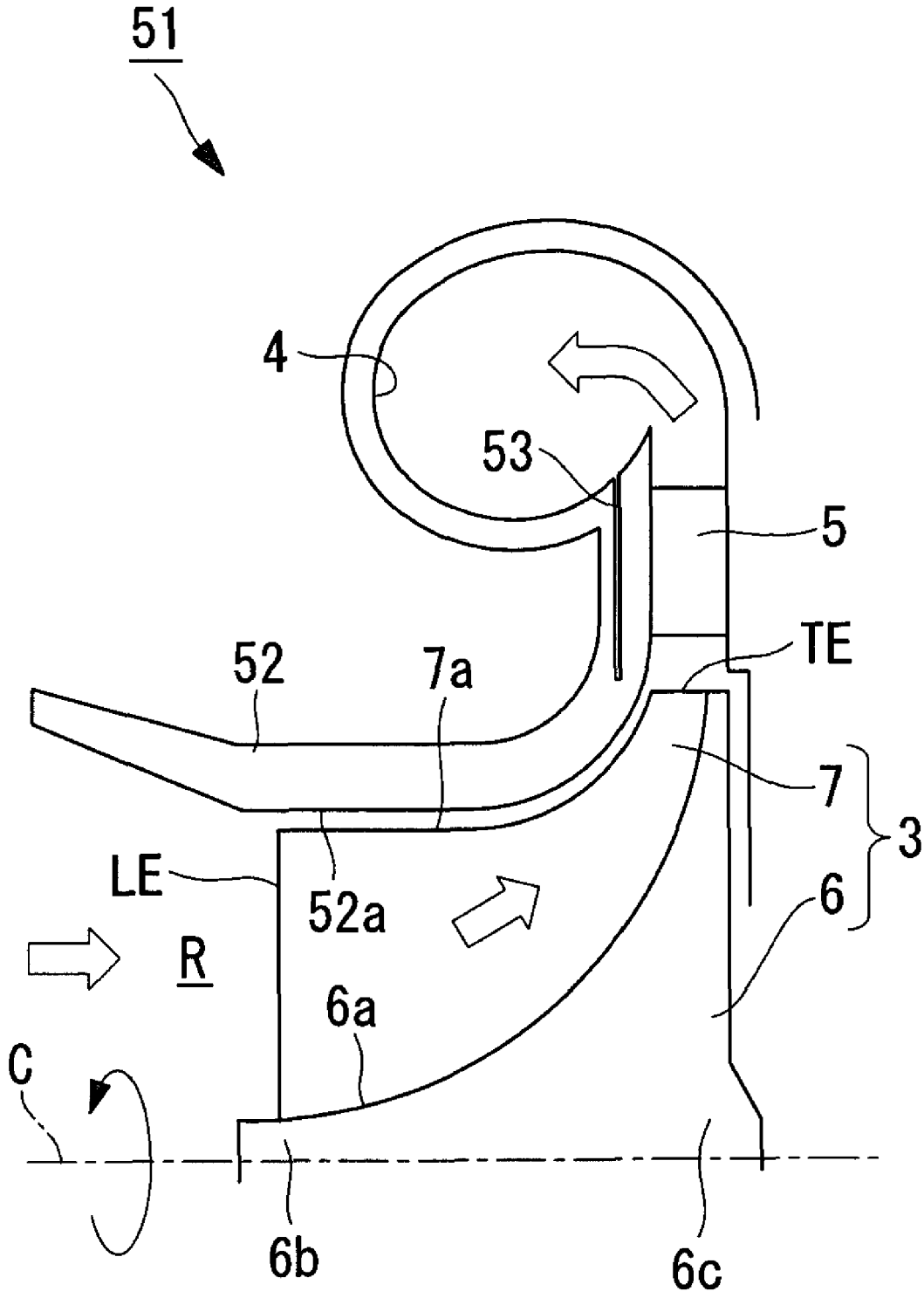
FIG. 5 is a cross-sectional view of a compressor provided with a compressor housing according to a fifth embodiment of the present invention.
Figure 6:
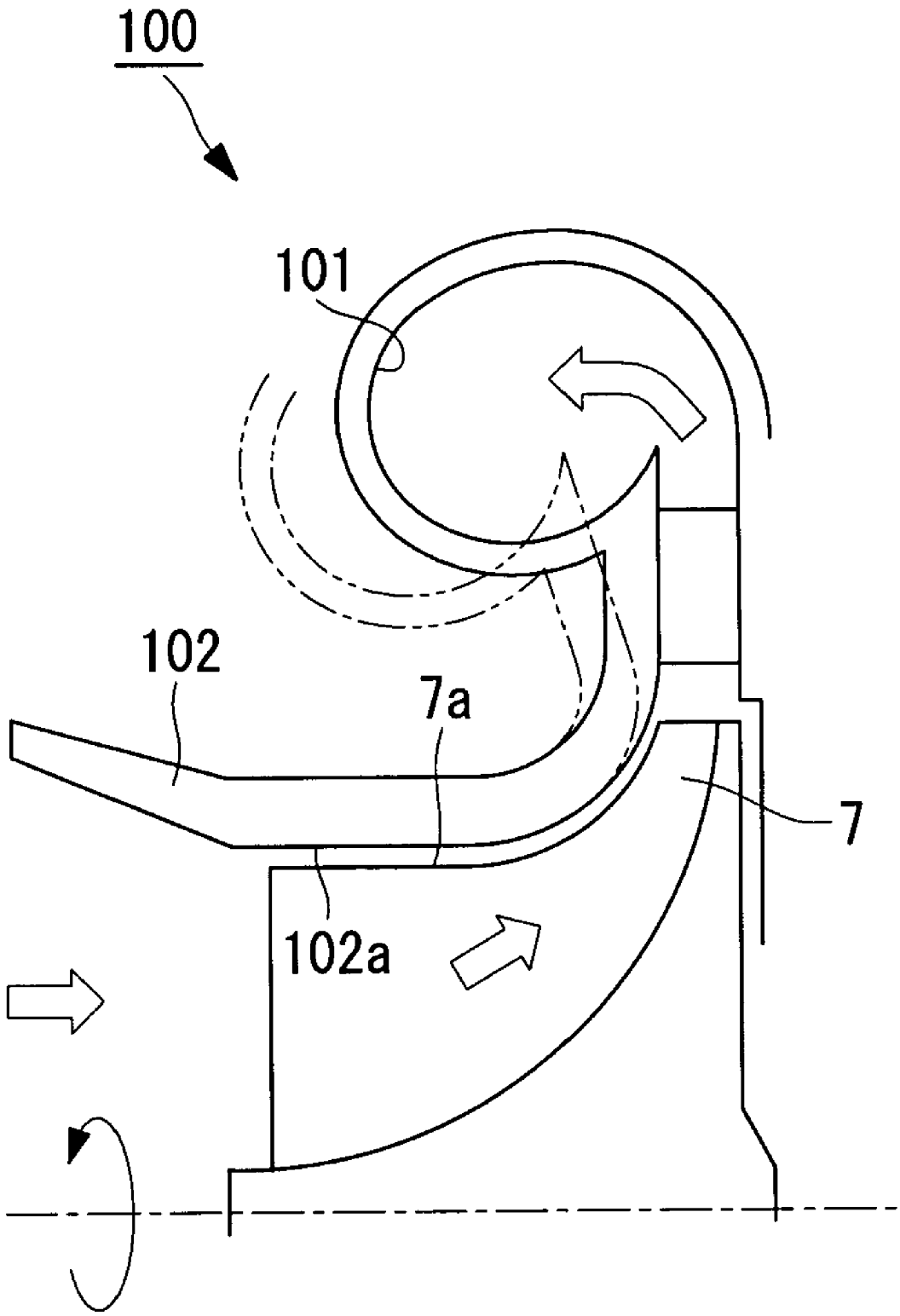
FIG. 6 is a cross-sectional view of a compressor provided with a conventional compressor housing, and is used to explain a problem inherent to the conventional technology.
Figure 7:
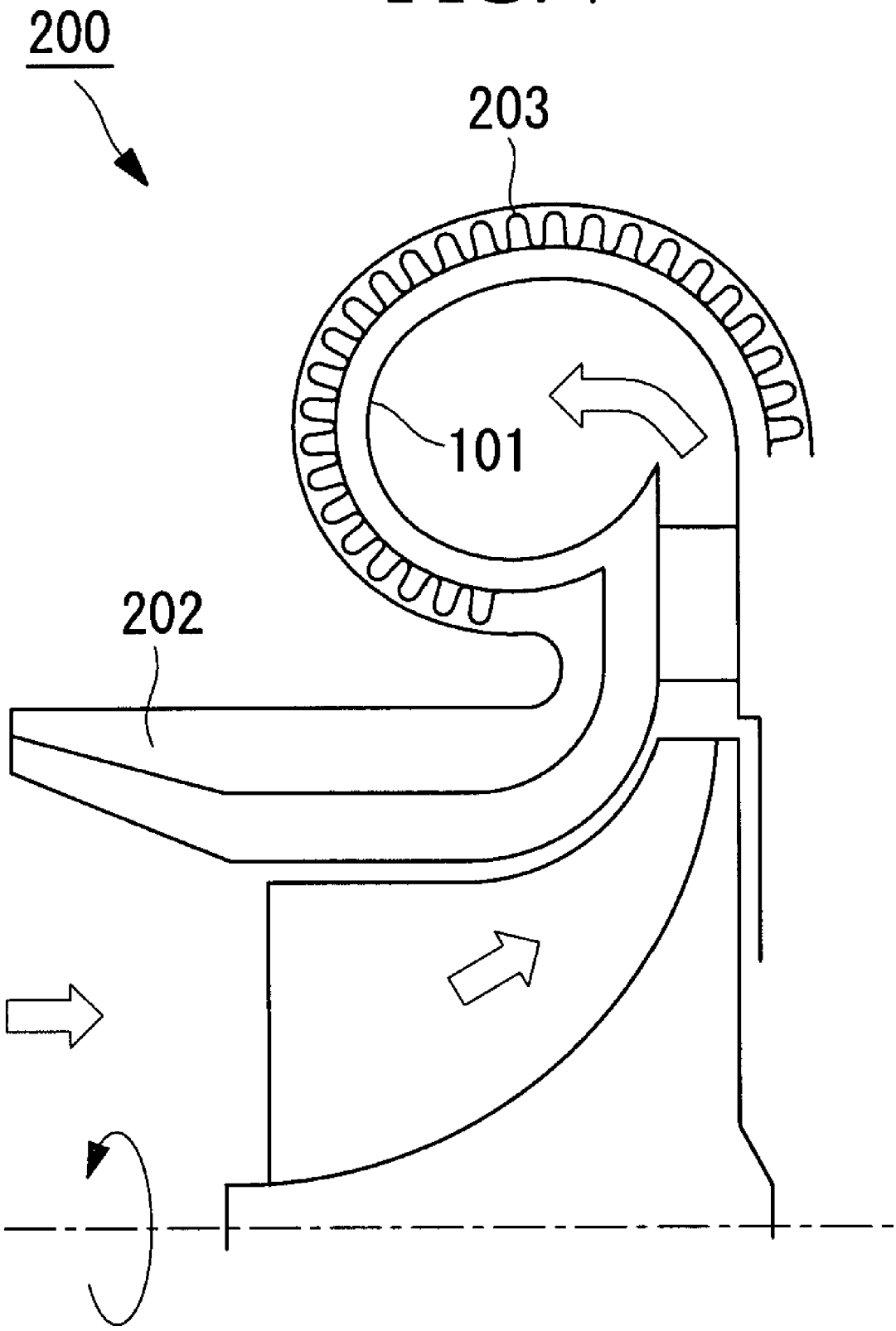
FIG. 7 is a cross-sectional view of a compressor provided with a conventional compressor housing, and is used to explain a problem inherent to the conventional technology.

The housing 52 of this embodiment is different from those of the above-described embodiments in that the housing 52 is made of a plastic material such as polyamide, and as shown in FIG. 5, is provided with a slit 53 cut into an inner wall face of the volute 4, the inner wall face being located at the inner side in the radial direction, toward an inner side in the radial direction along a plane approximately perpendicular to the rotational axis C of the impeller 3. Since the other components are the same as those of the above-described embodiments, a description of those components will be omitted.

According to the housing 52 of this embodiment, the slit 53 is formed at a second end of the housing 52, and only the second end (where the volute 4 is provided) of the housing 52 is thermally deformed by compressed air having a high temperature (for example, 180° C.).

Therefore, it is possible to always maintain the clearance between the blade tips 7*a* of the blades 7 and an inner circumferential face 52*a* of the housing 52 at an appropriate distance and to prevent a reduction in the efficiency of a centrifugal compressor 51.

The wall thickness of the housing 52 can be made almost equal to that of a housing made of a metal material such as aluminum cast iron or cast steel, so that it is possible to prevent an increase in the size of the housing 52 and an increase in the size of the centrifugal compressor 51.

Furthermore, since the entire housing 52 is made of a plastic material, the weight of the housing 52 can be reduced.

Note that the present invention can be applied not only to a centrifugal compressor but also to a mixed flow compressor.

The present invention is not limited to the above-described embodiments. Appropriate deformations, modifications, and combinations are possible, as needed, without departing from the technical concept of the present invention.

For example, in the third embodiment described with reference to FIG. 3, the clearance 24 is produced only at the second end of the inner cylinder 8. However, the clearance 24 can also be produced throughout the inner cylinder 8 from the first end thereof to the second end thereof.

What is claimed is:

1. A compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, the compressor housing comprising: an inner cylinder made of a plastic material and extending in an axial direction and in a circumferential direction to surround blade tips of the blades; and an outer cylinder made of a plastic material and extending in the axial direction and in the circumferential direction to surround the inner cylinder, wherein the inner cylinder and the outer cylinder are bonded or jointed at the first end, opposite the second end where the volute is formed.

2. A compressor housing according to claim 1, wherein the inner cylinder and the outer cylinder are bonded or jointed at the first end, opposite the second end where the volute is formed, and a clearance is provided between the other portions of the inner cylinder and the outer cylinder.

3. A compressor housing according to claim 2, wherein the inner cylinder and the outer cylinder are bonded or jointed at the first end, opposite the second end where the volute is formed, and a clearance is provided between the other portions of the inner cylinder and the outer cylinder.

4. A compressor comprising a compressor housing according to claim 1.

5. A compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, the compressor housing comprising: an inner cylinder made of a metal material and extending in an axial direction and in a circumferential direction to surround blade tips of the blades; and an outer cylinder made of a plastic material and extending in the axial direction and in the circumferential direction to surround the inner cylinder, wherein the inner cylinder and the outer cylinder are bonded at the first end, opposite the second end where the volute is formed.

6. A compressor comprising a compressor housing according to claim 5.

7. A compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, wherein a core member made of a metal material is embedded in a housing main body made of a plastic material in an axial direction and in a circumferential direction to surround blade tips of the blades.

8. A compressor comprising a compressor housing according to claim 7.

9. A compressor housing which houses an impeller having a plurality of blades and a main body provided at base parts of the plurality of blades, in a rotatable manner about a rotational axis, which has an intake passage formed at a first end thereof for guiding working fluid to the impeller, and which has a volute formed at a second end thereof, wherein a slit is provided which is cut into an inner wall face of the volute, the inner wall face being made of a plastic material and located at an inner side in a radial direction, toward an inner side in the radial direction along a plane approximately perpendicular to the rotational axis of the impeller.

10. A compressor comprising a compressor housing according to claim 9.

* * * * *